United States Patent [19]

Schiavello et al.

[11] Patent Number: 4,852,317

[45] Date of Patent: Aug. 1, 1989

[54] DEMOUNTABLE PANEL SYSTEM

[75] Inventors: Antonino Schiavello, Lower Templestowe; Richard A. Ramsdell, Templestowe, both of Australia

[73] Assignee: Schiavello Bros. (Vic.) Pty. Ltd., Victoria, Australia

[21] Appl. No.: 117,529

[22] Filed: Nov. 6, 1987

[30] Foreign Application Priority Data

Nov. 7, 1986 [AU] Australia ..... PG08852

[51] Int. Cl.[4] ..... E04H 1/00

[52] U.S. Cl. ..... 52/239; 52/580; 52/240; 52/242

[58] Field of Search ..... 52/238.1, 239, 588, 52/730, 580, 587

[56] References Cited

U.S. PATENT DOCUMENTS

| | | | |
|---|---|---|---|
| 3,293,813 | 12/1966 | Emmons et al. | 52/238.1 |
| 3,312,032 | 4/1967 | Ames | 52/580 |
| 3,327,440 | 6/1967 | Watkins | 52/239 |
| 3,378,977 | 4/1968 | Vervloet | 52/238.1 X |
| 3,789,567 | 2/1974 | Rae et al. | 52/588 X |
| 3,803,787 | 4/1974 | Daggy | 52/580 X |

FOREIGN PATENT DOCUMENTS

| | | | |
|---|---|---|---|
| 1275392 | 9/1961 | France | 52/239 |

*Primary Examiner*—Carl D. Friedman

*Attorney, Agent, or Firm*—Lowe, Price, LeBlanc, Becker & Shur

[57] ABSTRACT

A demountable panel system has panel members formed with peripheral edge surround sections of extruded rigid material. The surround sections included channels to receive panel material and leg portions with opposed grooves to releasably engage with a clip rail section. The clip rail section enables various panel structures, such as corner posts, to be interconnected with the panel members. The clip rail section has a tongue extending generally in the direction perpendicular to the panel member and so shaped as to be resiliently engageable with a tongue of an adjacent clip rail section whereby panel members or other panel structures can be clipped together along their length by relative transverse movement. The clip rail section includes opposed, outwardly extending flanges and perpendicular leg parts which cooperate with the channels of the surround section to form a recess having a narrow mouth. A workstation support bracket is retained behind a nib in the recess and wedges therein to lock the bracket relative to the panel members.

16 Claims, 6 Drawing Sheets

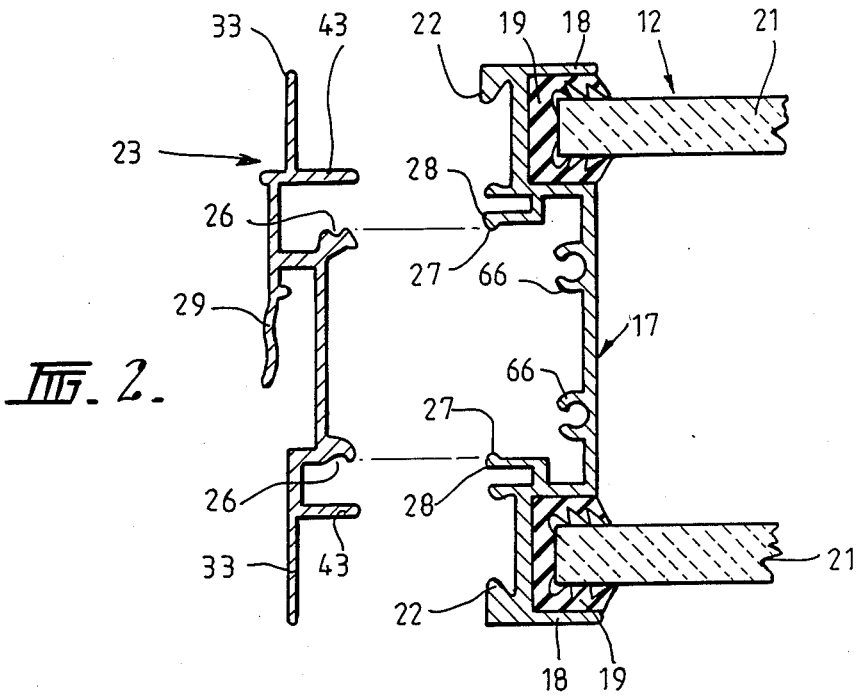
FIG. 2.
FIG. 3.
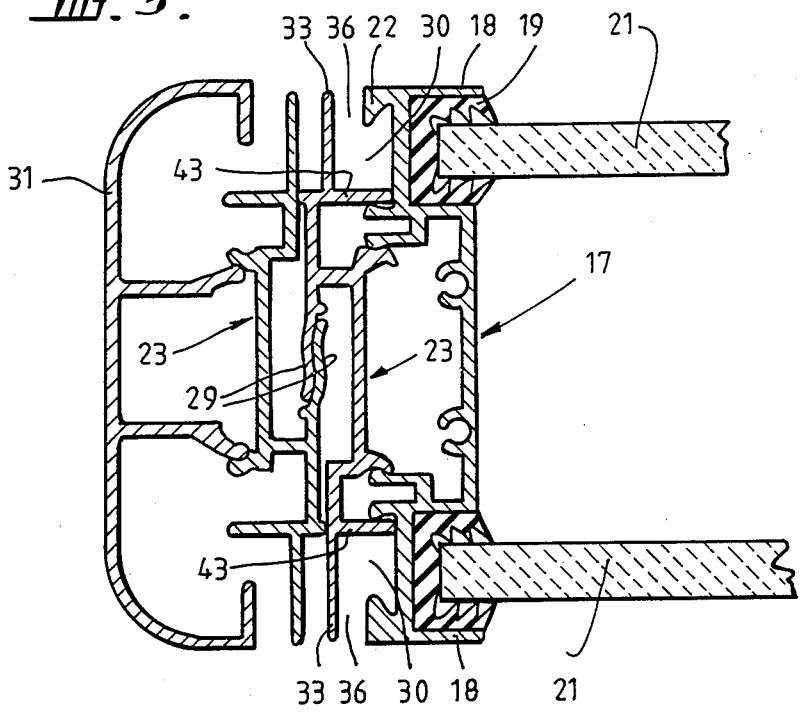

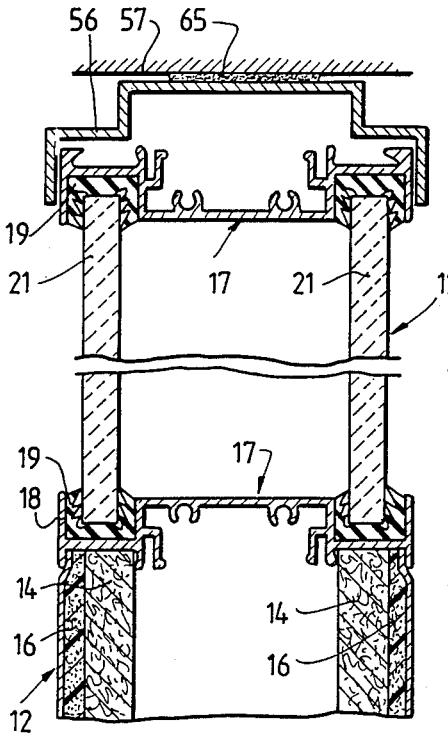
FIG. 11.
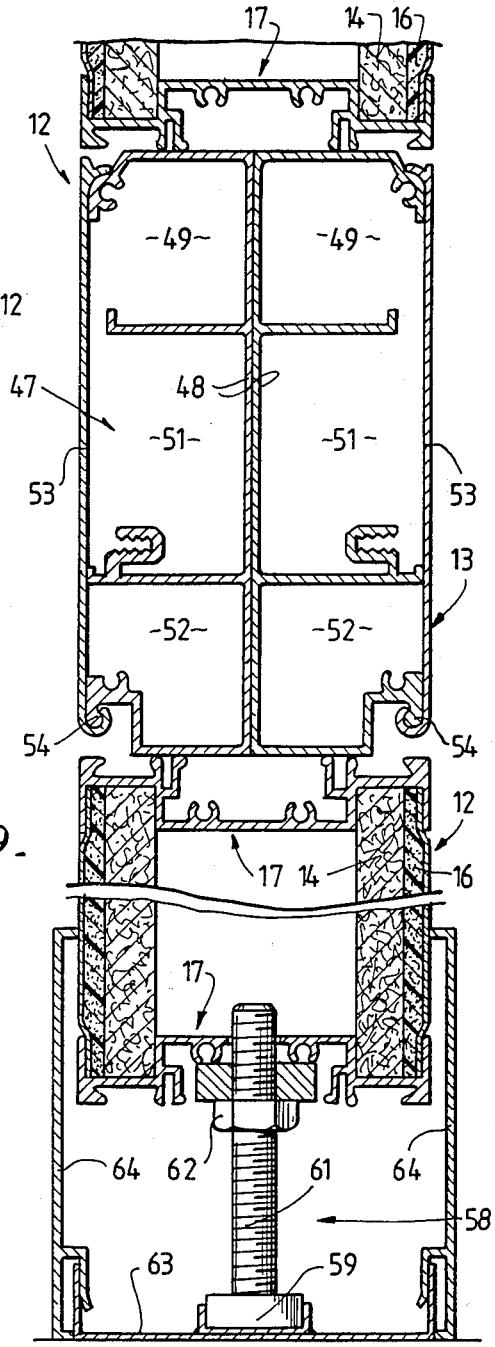
FIG. 9.
FIG. 10.
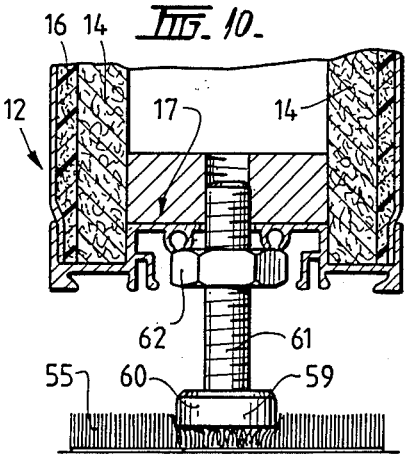

DEMOUNTABLE PANEL SYSTEM

BACKGROUND OF THE INVENTION

This invention relates to a demountable panel system and relates particularly to a demountable panel system for use in partitioning for offices, schools, or any other building structure. The invention also relates to a system which facilitates workstation design and construction to individual requirements but which also allows changes to be made at any time.

Generally, partitions for offices and the like are formed of fixed partition material which may be built in situ or formed of prefabricated panels and erected on site. More recently, partitions have been formed of demountable partition panels which can be removed and transported to another site as required.

Heretofore, demountable partitions have been expensive to install due to the relative high cost of the materials used and the labour costs associated with erection. Thus, the demountable partitions were constructed of solid panels with edging of metal, usually extruded aluminium, which could be screwed or bolted together. Cover strips covered the joining screws and could be removed to enable the partitions to be removed when necessary.

To reduce the costs of such demountable partitions, cheap construction methods and cheap materials have been used. However, this has resulted in relatively light weight partitions which are subject to damage, structural failure and shortened life.

It is therefore desirable to provide a panel system which can be used for the construction of office partitioning and the like and which, when assembled, results in a partition having strength, durability and sound absorption properties similar to that of fixed partitioning but which is demountable and can be readily moved to different locations.

Modern office equipment and office layout designs need to utilize the advantages of computers, word processors and other similar equipment. For this purpose, it has become common practice to develop workstations for individual staff members, each workstation being individually designed in accordance with the working requirements of the user. Such workstations generally require a form of desk with either walls or low-level partitions separating one workstation from another.

It is a desirable feature of the present invention that such workstations can be constructed utilizing the demountable panel system of the present invention.

It is also desirable that the panel system of the invention is relatively economical to produce, is simple to erect and is able to be moved from place to place and re-erected with the same or a different format.

SUMMARY OF THE INVENTION

In accordance with one aspect of the present invention there is provided a demountable panel for assembly with other similar panels to form a partition structure or workstation, said panel comprising a panel member having at least opposed side edges defined by a surround section of a shape to be secured to the panel member, the surround section including leg means extending along the length thereof to releasably engage cooperating parts of a clip rail section, a flange on the clip rail section extending generally in a direction perpendicular to the plane of the panel member, the flange having a shape to snap-engage with a similar flange of the partition structure or workstation by an engaging movement perpendicular to the panel member.

The demountable panel of the invention is preferably used with other panel members and related parts in a system which may include a number of panel members of square or rectangular outline the perimeter of which is formed by metal surround sections with coplanar legs defining spaced recesses to receive and support spaced lining material, such as plasterboard, plywood, particleboard, glass or the like. If desired, the lining material may be faced, such as with a fabric or other suitable facing material.

The panel members are connected to each other by utilizing the clip rail section which is releasably engaged with the surround sections on at least the opposed edges of the panel members. In one form of the invention, the clip rail sections are slidably engaged with the surround sections although in a most preferred arrangement, the clip rail sections are snap fitted to the surround sections.

The flange on each clip rail section is preferably resilient permitting snap engagement (in a lateral direction relative to the plane of the panel members) either with an adjacent clip rail section fitted to an adjacent panel member or to similar flanges on other clip rail sections fixed to structure members such as a post section or a capping section or other demountable part used to form a partition wall or workstation.

In constructing workstations of a variety of designs and arrangements, it is necessary to support horizontal work platforms, desk tops, drawer sets, equipment supports and the like at desired locations. For this purpose, the present invention provides for a workstation bracket having a head portion engageable within a channel formed when a surround section is engaged with a clip rail section, the channel extending the length of the relevant section. A mouth of the channel is preferably defined on one side by a nib part of the surround section. The head portion of the bracket includes a shoulder engageable behind the nib part preventing lateral disengagement of the head portion from the channel. The bracket further includes a wall engaging projection spaced from the head portion and arranged to engage the channel wall opposite the nib part while the head portion engages behind the nib part. The head part may also be formed with a wall engaging shoulder to cause the bracket to be able to be firmly wedged within the channel.

The bracket according to this aspect of the invention can be located at any position along a channel formed by the surround section and clip rail section. In the preferred embodiments, a locking screw engages through a lug on the bracket to bear against the wall of the channel to hold the bracket in a wedged position in the channel with the channel wall engaging projection firmly contacting the channel wall while the head portion is wedged between the nib part and the opposed wall.

The bracket may have any suitable configuration for supporting a workstation desk top, bench, item of equipment or anything else which needs to be secured relative to the panel system. Naturally, any number of brackets may be utilized in conjunction with the panel system to build up a workstation of any suitable design.

In order that the invention is more readily understood embodiments will now be described with reference to the drawings wherein FIG. 1 is a perspective view of a demountable panel system in accordance with the present invention, FIG. 2 is a sectional plan view of a panel member of the invention showing the surround section and a clip rail section, FIG. 3 is a sectional plan view taken along the lines 3—3 of FIG. 1, FIG. 4 is a sectional plan view taken along the lines 4—4 of FIG. 1, FIG. 5 is a sectional plan view taken along the lines 5—5 of FIG. 1, FIG. 6 is a sectional plan view taken along the lines 6—6 of FIG. 1, FIG. 7 is an elevational sectional view taken along the lines 7—7 of FIG. 6, FIG. 8 is a perspective view of a left-hand workstation support bracket, FIG. 9 is a sectional view taken along the lines 9—9 of FIG. 1, FIG. 10 is a sectional view taken along the lines 10—10 of FIG. 1, and FIG. 11 is a further sectional view taken along the lines 11—11 of FIG. 1.

DESCRIPTION OF THE PREFERRED EMBODIMENT

The drawings herewith illustrate a demountable panel system which comprises a number of panel members generally of rectangular outline.

The individual panel members are formed with paced, parallel lining material such as plasterboard, plywood, particle board, glass, metal, plastics material or the like. Any other suitable form of lining material may be used in the performance of the invention and, where glass is used, either one or two sheets may be used as required.

Figure 1:
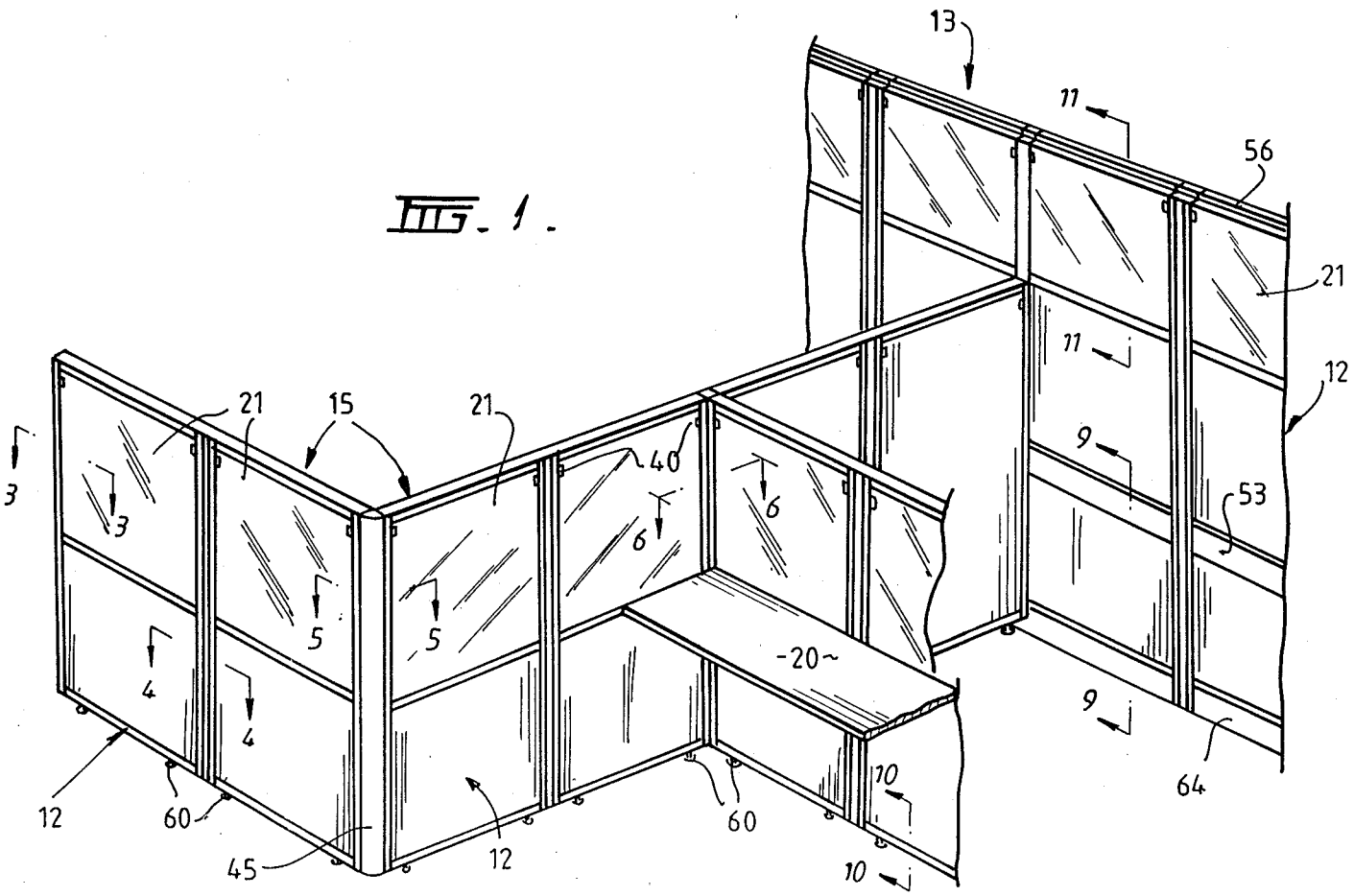

FIG. 1 shows, for the purposes of illustration of the features of this invention, a partition structure which comprises a main, full height partition wall 13 and three-quarter height partition dividers 15 defining workstation areas, in one of which is a work-top 20.

The upper panel members 12 of the wall 13 and the upper panel members 12 of the dividers 15 are formed of a pair of glass sheets 21 while the lower panel members 12 comprise spaced plasterboard sheets 14 with a facing of foam-backed fabric material 16. The fabric material provides an aesthetically pleasing appearance to the panel while the foam backing ensures that the fabric material remains relatively smooth and pleasant to touch.

As shown in the drawings, the panel members 12 are formed as a unitary construction with the peripheral edges of the spaced sheets 14, 16 supported by surround sections 17 which can be formed of extruded aluminium, alloy, plastics material or other relatively rigid material. The surround sections 17 are formed with a pair of spaced channels 18 to directly receive the sheets 14, as shown particularly in FIG. 4, or to receive glazing gaskets 19 which support glass sheets 21 as shown in FIGS. 2 and 3.

The surround sections 17 are further formed with a nib part 22 of relatively thick material, the purpose of which is hereinafter described.

Each panel member 12 may be interengaged with another panel member or with other panel system parts through the use of clip rail sections 23 shown particularly in FIG. 2. Each clip rail section 23 is formed with a pair of legs having longitudinal cooperating grooves 26 to receive ribs 27 on leg parts 28 of the surround sections 17. The grooves 26 are preferably engaged with the ribs 27 by longitudinal sliding to ensure that the clip rail sections 23 are firmly secured to the surround sections 17 against dis-engagement in a transverse direction.

Figure 4:
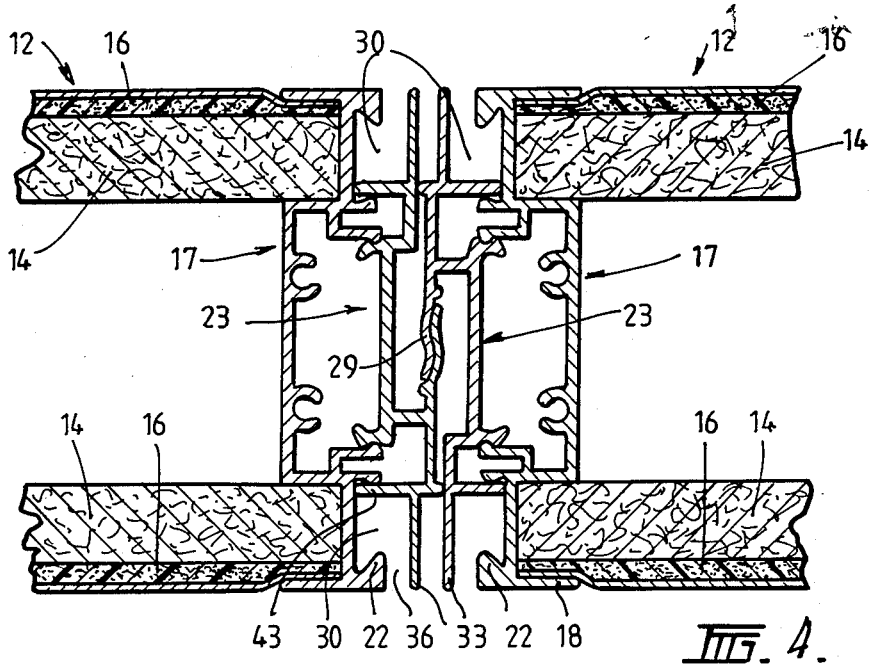

The clip rail section 23 is formed with a laterally extending flange or tongue 29 having a "wave" or elongated S configuration. The tongue 29 is so disposed as to be engageable by a similar tongue 29 of an adjacent clip rail section 23 to releasably lock two clip rail sections together. The engaging movement is a movement perpendicular to the plane of the panel members 12 to thereby snap adjacent panel members together as shown in FIG. 4. Alternatively, a clip rail section 23 may be engaged with an end cap 31 (FIG. 3) or a corner post 32 (FIG. 5) or an intermediate post, which may be identical to a corner post 32, as shown in FIG. 6.

It will thus be seen that the structure of the panel members, the surround sections 17 and the clip rail sections 23 enable a number of panel members 12 to be interengaged with each other or with end caps 31 or posts 32 to form a panel system. The provision of the tongue 29 on the clip rail sections 23 ensures ease of assembly as well as dis-assembly of panel members with each other and with the other various sections as illustrated.

A feature of the present invention is the ability to assemble the panel members 12 in any desired arrangement to constitute partitioning or to form workstations of any desired design or configuration. For this purpose the clip rail section 23 is constructed with opposed flanges 33 and leg parts 43 extending at right angles thereto. When assembled with a surround section 23, the flanges 33 and leg parts 43 combine with the base part of the channels 18 and the nib part 22 to form a recess 30 with a restricted mouth 36.

Figure 6:
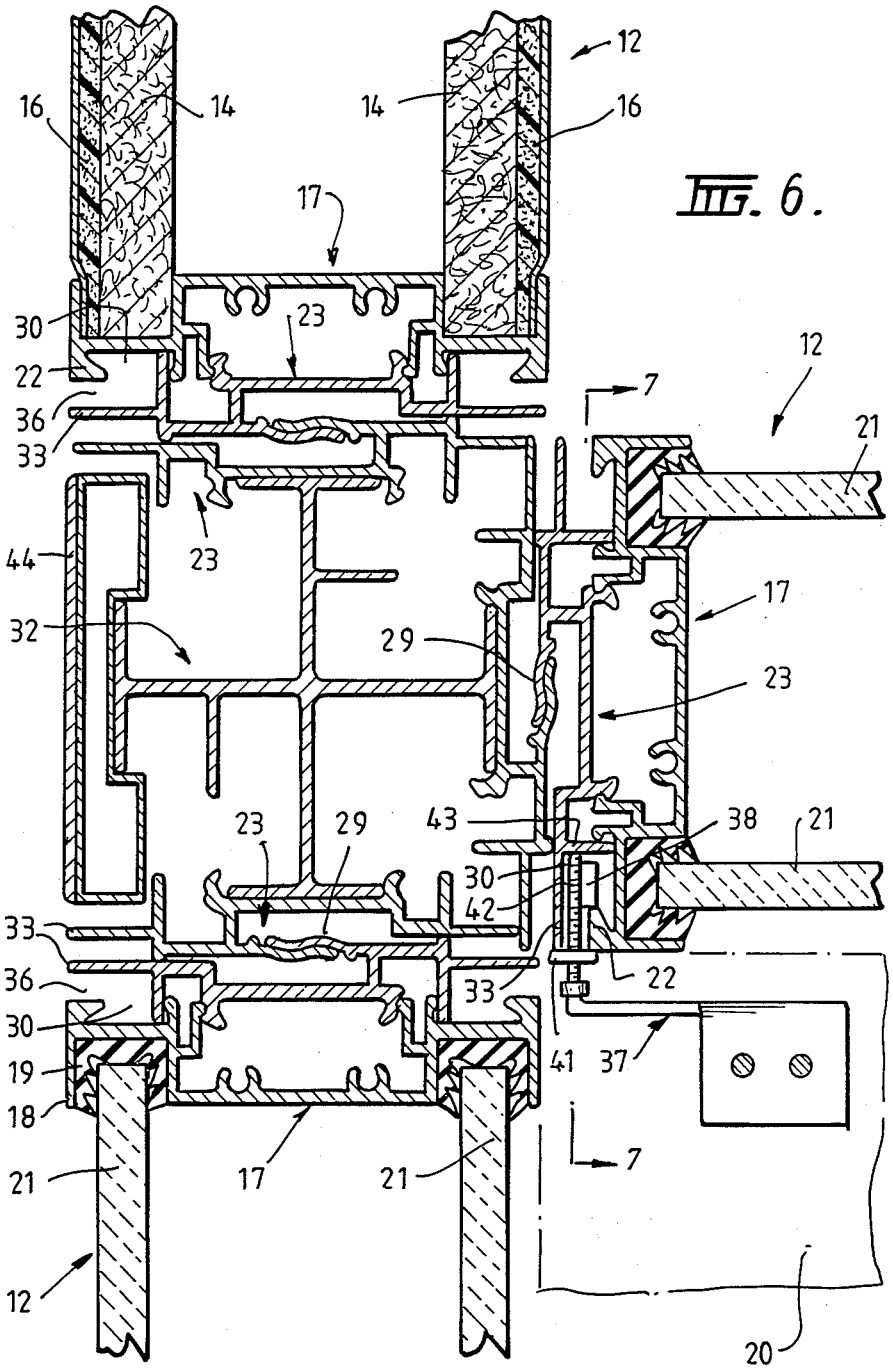
Figure 7:
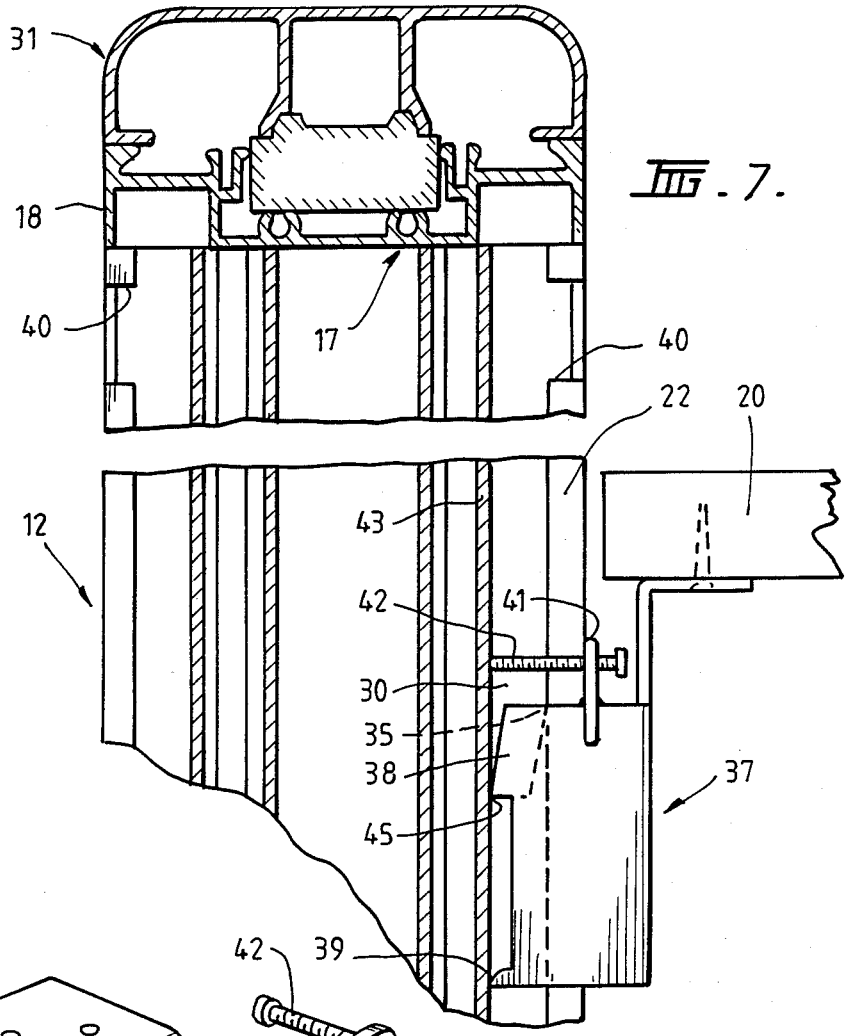
Figure 8:
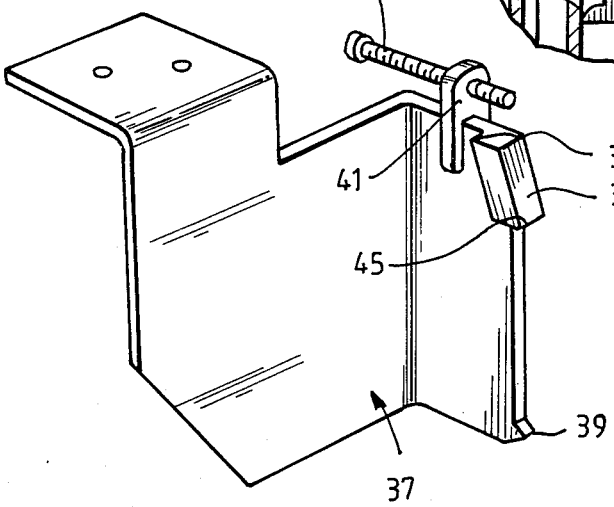

As seen in FIGS. 6, 7 and 8 workstation bracket 37 is designed to engage within the recess 30 to support workstation equipment such as desk tops, drawer sets and the like from the panel assembly. The workstation bracket 37 includes a head portion 38 which is engageable within the recess 30 and has a width greater than the width of the mouth 36 defined by the flange 33 and nib part 22. At a lower end of the bracket 37 there is provided a pointed projection 39 spaced some distance below the head portion 38. The bracket 37 also includes a lug 41 having a threaded screw 42 passing through the mouth 36 and adapted to engage on the rear wall of the recess 30 formed by the leg part 43 of the clip rail sections 23.

In use, the bracket head portion 38 is engaged within the recess 30 through a cut-away portion 40 of the nib part 22, shown in FIG. 7. The head portion 38, which is angled relative to the bracket 37, has opposed corner shoulders 35 and 45 which contact the nib part 22 and the opposed leg part 43. In a loaded position, the point of projection 39 also engages the rear wall of the recess 30 formed by the leg part 43. Thus, the bracket head 38 becomes "wedged" within the recess 30 to prevent relative, vertical movement of the bracket 37 while the projection 39 acts also to lock the bracket 37 in position and to resist deformation of the recess 30 by the head portion 38. The nib part 22, being of thickness relatively greater than that of other parts of the surround sections 17 provides the strength necessary to support the appropriate loadings on the bracket 37. The threaded screw 42 is moved into engagement with the leg part 43 to hold the bracket in the "wedged" position.

The bracket 37 may be used to support a desk top, a computer stand, a set of drawers or any other item of equipment which is required to be supported for use by an operator. Shelves and other items can also be supported by appropriate bracket constructions.

The bracket 37 can be moved from its locked or "wedged" position by releasing the screw 42 and lifting the body to move the shoulders 35 and 45 and projection 39 out of locking engagement with the walls of the recess 30. The bracket is then able to slide vertically in the recess 30.

Referring to FIG. 4 of the drawings, there is illustrated two panel members 12, both of which are formed of fibrous plaster sheets 14 with foam backed fabric material 16. The interconnection of the two clip rail sections 23 produces two recesses 30 on each side with which brackets 37 may be engaged.

Figure 5:
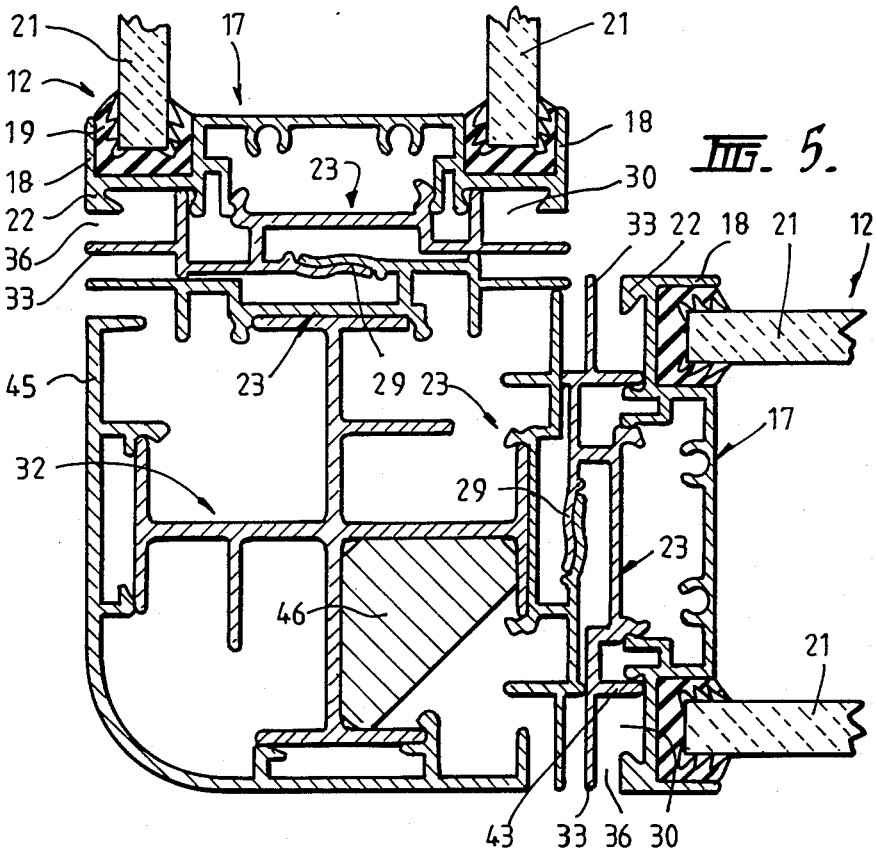

FIG. 5 shows two panel members having double glazing 21 interconnected utilizing a post 32 as a corner post. A corner cover 53 is clipped to the post 32. If necessary for structural integrity, the post 32 may be reinforced by an appropriate reinforcing member 46.

In FIG. 6, there is shown three panel members 12 interconnected to each other using the post 32 enabling the clip rail sections 23 to be connected thereto and also having the open side covered with a cover strip 44.

Referring to FIG. 9, there is illustrated a section of a partition wall 13 which includes a pair of opposed power cable ducts 47 which are incorporated within the panel member 12 to enable power cables, telephone cables, computer cables and the like to be fed through the panel members 12 to appropriate workstations, telephones and power outlets. The power ducts 47 extend generally horizontally and include a back-to-back internal duct members 48 which are fastened at each end to the vertically extending surround sections of the relevant panel. Each internal duct member 48 includes three compartments 49, 51 and 52 to separately contain the individual cables for telephone, power and computers. A front cover 53 is hingedly connected to a lower edge 54 to permit access to the cable ducts 49, 51 and 52. Power outlets, computer connectors, telephone outlets and the like are fixed to the duct member 48 and openings are provided in the cover 53 to provide access to those outlets.

At the base of the panel member 12, a height adjustment mechanism 58 incorporating a base 59 a threaded post 61 and a nut 62 is positioned on a channel 63. A skirting section 64 engages with the channel 63.

In an alternative arrangement where the partition wall 13 is to be supported on existing carpet 55, a simple height adjusting foot 60 engages with the lower surround section and has a base 59 which rests directly on the carpet 55 as shown in FIG. 10.

The panel members of the present invention are designed to be used as full height and half height partitions as well as for use as workstation panels. In utilizing the panel members as full height partitions, as shown in FIG. 11 an upper facial member 56 may be utilized over the upper surround section 17 and which engages with the ceiling 57 of the area in which the partition is to be installed. If desired, an appropriate mastic sealing material 65 can be imposed between the facia member 56 and the ceiling 57.

The panel system according to the present invention is easily demountable and, therefore, movable from place to place without structural change in respect of the building in which the system has been installed. Relocation of power points, computer terminal outlets, telephone outlets and the like can be made simply and without the need to dismantle or reconstruct partitions or panel members.

The panel system may be constructed utilizing a variety of different types of panel members interconnected horizontally and/or vertically with other panel members. In some cases, a single panel member 12 will incorporate a lower part formed of plasterboard sheet material 14 or the like, an intermediate cable duct 47 and an upper part formed of single or double glass sheets 21. The particular design of the surround sections 17 is devised to provide longitudinal semi-circular channels 66 to receive fastening screws from other parts for positively securing parts together. Also, the leg parts 67 (FIG. 2) provide support for the recess base legs 43 of the clip rail section 23.

We claim:

1. A demountable panel for assembly with other similar panels to form a partition structure or workstation, said panel comprising a clip rail section, a panel member having at least opposed side edges defined by a surround section of a shape to be secured to the panel member, the surround section including leg means extending along the length thereof to releasably engage cooperating parts of the clip rail section, said clip rail section having a tongue extending generally in a direction perpendicular to the plane of the panel member, the tongue having a shape to engage with a similar tongue of the partition structure or workstation by an engaging movement perpendicular to the panel member.

2. A demountable panel according to claim 1 wherein the surround section comprises laterally spaced, parallel channels to receive spaced, parallel sheets of panel material, and the leg means comprises a pair of legs extending in a direction opposite the channels, the legs having either ribs or grooves and the clip rail section having either corresponding ribs or grooves to engage with said grooves or ribs on the legs.

3. A demountable panel according to claim 1 wherein said surround section has a rib part on each side of the surround section which rib part defines, with opposed flange parts and leg portions of the clip rail section, a recess with a restricted mouth.

4. A demountable panel according to claim 3 wherein said rib part is cut-away at a location along its length to receive a head of a mounting bracket into the recess.

5. A demountable panel according to claim 1 wherein said clip rail section tongue is of elongated S-shape in cross section and is sufficiently resilient to snap-engage a similar tongue of an adjacent clip rail section.

6. A demountable panel according to claim 1 wherein said surround sections and said clip rail sections are extruded aluminum alloy sections and the panel members include panel material selected from the group of foam-backed fabric covered plasterboard, plywood, glass and veneered particle board.

7. A demountable panel system comprising a plurality of demountable panels according to claim 3 interengaged with each other by snap-engagement of the tongues of clip rail sections engaged with the surround sections on each panel member or with clip rail sections and including post means interposed between adjacent panel members to which post means the clip rail sections are mounted.

8. A system according to claim 7 wherein a mounting bracket is engaged with one of the recesses formed by the surround sections and clip rail sections mounted thereto, said mounting bracket having a body part of a width to pass through the recess mouth, a head on the body part of a width greater than the recess mouth but of dimensions to be slidably received in the recess, wall engaging means on the body part spaced from the head, and locking means, said head having shoulders which engage behind the nib part and on the rear wall of the recess, respectively, when downward forces are exerted on the body part, to thereby wedge the head in the recess, and the wall engaging means also engaging said recess rear wall below said head.

9. A system according to claim 8 wherein said locking means comprises a lug on the body part and a screw threaded through said lug and arranged to engage a panel member to hold the bracket body part in the position with the shoulders wedged within the recess.

10. A demountable panel system according to claim 7 wherein at least one of said panel members includes at least one cable channel extending substantially horizontally between side surround sections, said cable channel having internal partitioning dividing the channel into at least two compartments, and a front closure panel hinged along its lower edge to the channel and having an upper edge to snap-engage an upper edge portion of the channel.

11. A demountable panel system comprising a plurality of panel members, clip rail sections for interconnecting panel members to each other, post means for connecting panel members to extend at an angle to each other and bracket means for attaching workstation structures to assembled panel members, said panel members comprising peripheral surround sections at least the side sections having channel means to receive sheet panel material, the side surround sections each including mounting means for mounting a clip rail section thereon, tongue means on the clip rail section extending generally transversely to the plane of the panel member, said tongue means being formed to engage with and be held to tongue means of a similar, adjacent clip rail section by relative lateral movement.

12. A panel system according to claim 11 wherein the side surround sections are each formed with a pair of channels laterally spaced to receive spaced sheets of panel material.

13. A panel system according to claim 12, wherein said channels include rear surfaces and wherein a nib part extends from the rear surface of each channel.

14. A panel system according to claim 13 wherein each clip rail section attached to a side surround section has a pair of legs extending substantially parallel to the plane of the associated panel member and an outwardly extending flange at right angles to an adjacent one of said pair of legs, each leg being adapted to engage the rear surface of an adjacent channel and form therewith and with the respective flange a recess the mouth of which is partially closed by said nib part.

15. A panel system according to claim 14 wherein said bracket means includes a head part which engages within said recess, said head part having shoulder edges to engage with the recess rear wall and the nib part to wedge the head part against movement along the recess in a given direction.

16. A panel system according to claim 11 wherein said post means comprises an elongated section of a cross configuration with flanges on the ends of each cross arm to receive a clip rail section thereon or an end cap or corner cover.

* * * * *